US011503873B2

(12) United States Patent
Garneau et al.

(10) Patent No.: US 11,503,873 B2
(45) Date of Patent: Nov. 22, 2022

(54) CYCLING SHOE WITH LATERAL METATARSAL EXPANSION ZONE

(71) Applicant: LOUIS GARNEAU SPORTS INC, St-Augustin-de-Desmaures (CA)

(72) Inventors: Louis Garneau, Saint-Augustin-de-Desmaures (CA); René Plourde, Québec (CA)

(73) Assignee: LOUIS GARNEAU SPORTS INC, Quebec (CA)

( * ) Notice: Subject to any disclaimer, the term of this patent is extended or adjusted under 35 U.S.C. 154(b) by 0 days.

(21) Appl. No.: 15/837,193

(22) Filed: Dec. 11, 2017

(65) Prior Publication Data

US 2018/0160764 A1 Jun. 14, 2018

Related U.S. Application Data

(60) Provisional application No. 62/432,901, filed on Dec. 12, 2016.

(51) Int. Cl.
*A43B 5/14* (2006.01)
*A43B 23/02* (2006.01)
(Continued)

(52) U.S. Cl.
CPC ..... *A43B 5/14* (2013.01); *A43B 23/0205* (2013.01); *A43B 23/027* (2013.01);
(Continued)

(58) Field of Classification Search
CPC ..... A43B 5/14; A43B 5/1625; A43B 5/1666; A43B 5/1675; A43B 5/1683; A43B 7/085;
(Continued)

(56) References Cited

U.S. PATENT DOCUMENTS 641,642 A * 1/1900 Gunn ..... A43B 3/26 36/97
4,222,183 A * 9/1980 Haddox ..... A43B 7/06 36/114

(Continued)

FOREIGN PATENT DOCUMENTS

EP 1712147 A1 10/2006

OTHER PUBLICATIONS

European Search Report for corresponding application EP17206343; dated Apr. 30, 2018.

*Primary Examiner* — Timothy K Trieu
*Assistant Examiner* — Dakota Marin
(74) *Attorney, Agent, or Firm* — Cantor Colburn LLP

(57) ABSTRACT

A cycling shoe comprises a sole defining an undersurface of the cycling shoe, the sole having connection holes configured for connection of a pedal cleat to the sole. An upper is connected to the sole and defining with the sole a foot-receiving cavity. An expansion zone is located in a lateral or medial subportion of a metatarsal portion and/or toe portion of the cycling shoe and configured to be opposite a portion of at least a fifth metatarsal of a wearer of the cycling shoe, the expansion zone being entirely surrounded by a window of structural upper paneling and defined by at least one panel having a greater stretching characteristics than the structural upper paneling of the window.

24 Claims, 7 Drawing Sheets

(51) Int. Cl.
*A43B 5/16* (2006.01)
*A43B 7/08* (2022.01)

(52) U.S. Cl.
CPC ..... *A43B 23/0235* (2013.01); *A43B 5/1625* (2013.01); *A43B 5/1666* (2013.01); *A43B 5/1675* (2013.01); *A43B 7/085* (2013.01); *A43B 23/025* (2013.01); *A43B 23/026* (2013.01)

(58) Field of Classification Search
CPC ..... A43B 23/0205; A43B 23/0235; A43B 23/027; A43B 23/025; A43B 23/026
USPC ..... 36/131
See application file for complete search history.

(56) References Cited

U.S. PATENT DOCUMENTS 4,447,967 A * 5/1984 Zaino ..... B29D 35/064 36/87
4,679,335 A * 7/1987 Berlese ..... A43B 7/08 36/131
4,845,864 A * 7/1989 Corliss ..... A43B 5/14 36/131
4,984,320 A * 1/1991 Curley, Jr. ..... A43B 13/12 12/142 P
5,509,217 A * 4/1996 Condini ..... A43B 5/0405 36/10
5,768,807 A * 6/1998 Caeran ..... A43B 5/16 36/115
6,237,251 B1 * 5/2001 Litchfield ..... A43B 3/34 36/31
6,305,103 B1 * 10/2001 Camargo ..... A43B 23/047 36/45
6,457,265 B1 * 10/2002 Lepage ..... A43B 5/04 36/115
6,477,793 B1 * 11/2002 Pruitt ..... A43B 5/14 36/144
7,536,810 B2 * 5/2009 Jau, Jr. ..... A43B 5/14 36/131
7,941,943 B2 * 5/2011 Baker ..... A43B 5/02 36/133
8,429,835 B2 * 4/2013 Dojan ..... A43B 1/04 36/3 A
8,938,890 B2 * 1/2015 Raghuprasad ..... A43B 3/26 36/55
8,950,087 B2 * 2/2015 Baucom ..... A43B 3/0031 36/54
9,066,555 B2 6/2015 Holzer
9,420,845 B2 * 8/2016 Hsiao ..... A43B 3/248
2004/0084862 A1 * 5/2004 Wegener ..... A43B 3/26 280/11.26
2004/0128862 A1 * 7/2004 Flack ..... A43B 3/18 36/100
2004/0197529 A1 * 10/2004 Cadamuro ..... A43B 13/186 428/174
2005/0028404 A1 * 2/2005 Marvin ..... A43B 1/0072 36/45
2005/0253346 A1 * 11/2005 Lin ..... A43B 5/1616 280/11.221
2005/0284000 A1 * 12/2005 Kerns ..... A43B 1/04 36/45
2006/0064904 A1 * 3/2006 Confortin ..... A43B 5/04 36/117.1
2006/0112599 A1 * 6/2006 Braynock ..... A43B 1/0036 36/137
2007/0199210 A1 * 8/2007 Vattes ..... A43B 13/12 36/45
2009/0119948 A1 * 5/2009 Ortley ..... A43B 5/001 36/84
2009/0293318 A1 * 12/2009 Garneau ..... A43B 5/14 36/131
2009/0324905 A1 * 12/2009 Welch ..... A61F 13/15593 428/198
2010/0180469 A1 * 7/2010 Baucom ..... A43B 3/0031 36/100
2010/0269374 A1 * 10/2010 Hsieh ..... A43B 5/14 36/25 R
2012/0023783 A1 2/2012 Nichols
2012/0066931 A1 * 3/2012 Dojan ..... A43B 23/0235 36/83
2012/0132030 A1 * 5/2012 Kamada ..... B62M 3/086 74/594.6
2013/0055595 A1 * 3/2013 Brown ..... A43B 1/0018 36/136
2013/0174449 A1 * 7/2013 Koyess ..... A43B 5/1625 36/107
2013/0318817 A1 * 12/2013 Vattes ..... A43B 7/141 36/28
2014/0007463 A1 * 1/2014 Bird ..... A43B 13/12 36/131
2014/0237858 A1 * 8/2014 Adami ..... A43B 23/0205 36/107
2015/0289579 A1 * 10/2015 Meir ..... A43B 1/04 36/9 R
2016/0044988 A1 * 2/2016 Delgorgue ..... A43C 15/16 36/131
2016/0081422 A1 * 3/2016 Garneau ..... A43B 1/0081 36/7.2
2016/0143395 A1 * 5/2016 Van Atta ..... A43B 5/025 36/48
2016/0242489 A1 * 8/2016 Bennett ..... A43B 1/08
2016/0278476 A1 * 9/2016 Stien ..... A43B 7/20
2016/0302515 A1 * 10/2016 Xanthos ..... A43C 11/1493

* cited by examiner

CYCLING SHOE WITH LATERAL METATARSAL EXPANSION ZONE

CROSS-REFERENCE TO RELATED APPLICATION

The present application claims the priority of U.S. Provisional Patent Application Ser. No. 62/432,901, filed on Dec. 12, 2016 and incorporated herein by reference.

TECHNICAL FIELD

The present application generally relates to shoes such as cycling shoes, and to a construction of an upper thereof.

BACKGROUND OF THE ART

Cycling shoes are used with automatic pedals as a combination designed to maximize the transfer of pedaling power to the transmission of the bicycle, such as the chainset in standard bicycles. Accordingly, cycling shoes typically have rigid soles, i.e. plastomeric soles (e.g. hard plastics, metal, carbon), especially in the case of cycling shoes for road bikes or racing bikes, and are clamped by way of a cleat to the automatic pedal. Moreover, the upper is conventionally made of robust structural paneling materials to be secured firmly to the foot of the user.

However, it is known that feet are anatomically different from one person to another. Therefore, larger feet may not be adapted to some narrower types of shoes, and vice versa. This may force manufacturers to design wider and narrower shoes. There results stocks of shoes of different widths for a same size, and all inventory and cost issues related to such stocks, throughout the supply chain. It would be desirable to address this issue.

Another occurrence is that of cyclists using shoes that are too narrow. As the feet may have a tendency to flatten over the duration of a ride, cycling shoes may become uncomfortable during a ride, if not already tight when put on. In particular, the metatarsal region of the foot may fee particularly tight and uncomfortable, for example at a lateral location, or at a medial location—especially in the presence of a bunion.

SUMMARY

It is therefore an aim of the present disclosure to provide a cycling shoe that addresses issues related to the prior art.

Therefore, in accordance with the present disclosure, there is provided a cycling shoe comprising: a sole defining an undersurface of the cycling shoe, the sole having connection holes configured for connection of a pedal cleat to the sole; and an upper connected to the sole and defining with the sole a foot-receiving cavity, at least one expansion zone located in a lateral subportion of a metatarsal portion and/or toe portion of the cycling shoe and configured to be opposite a portion of at least a fifth metatarsal of a wearer of the cycling shoe, and/or located in a medial subportion of a metatarsal portion and/or toe portion of the cycling shoe and configured to be opposite a portion of at least a first metatarsal of a wearer of the cycling shoe, the at least one expansion zone being entirely surrounded by a window of structural upper paneling and/or sole and defined by at least one panel having a greater stretching characteristics than the structural upper paneling of the window.

DETAILED DESCRIPTION

Figure 1:
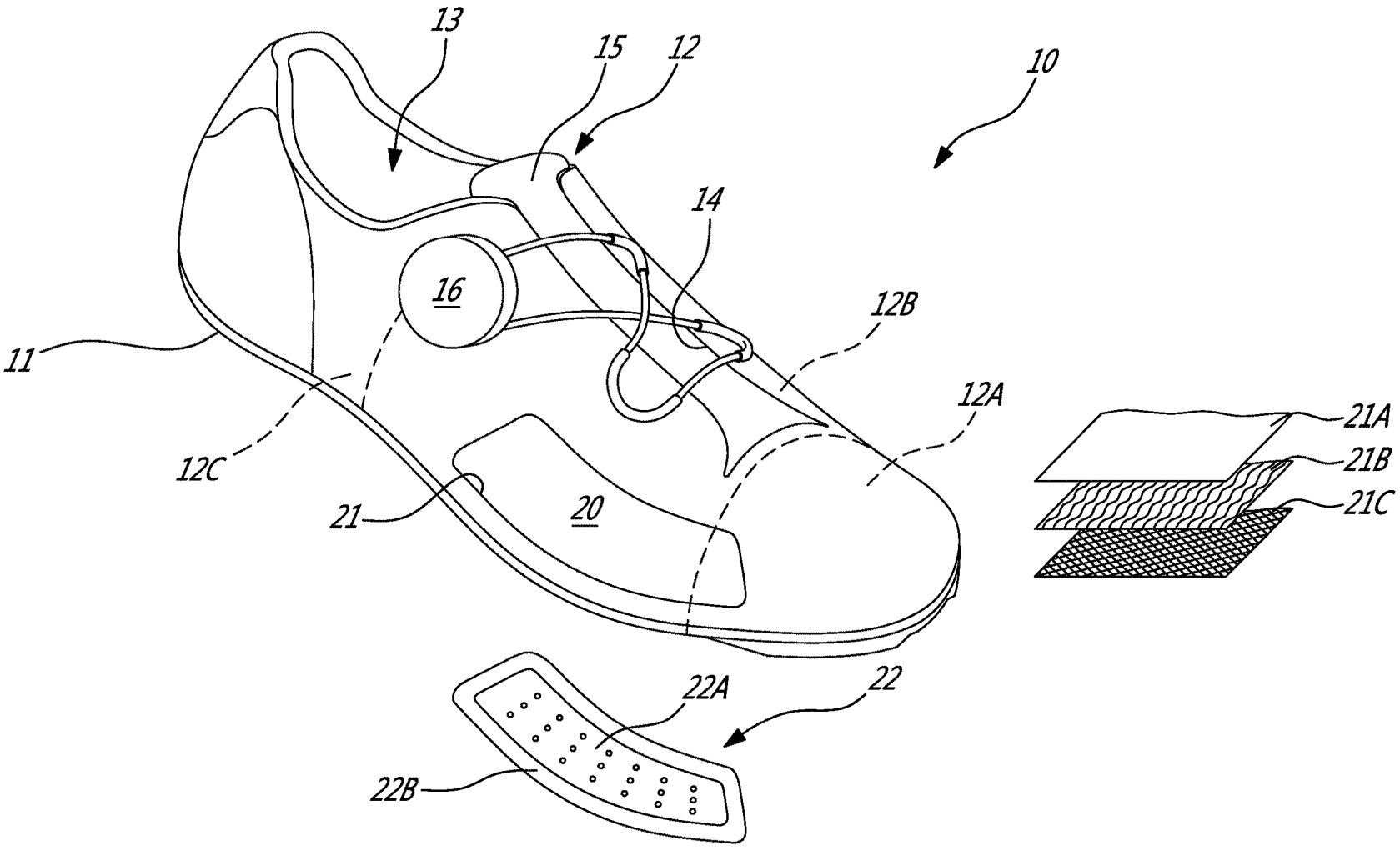
FIG. 1 is a perspective view of a cycling shoe with lateral metatarsal expansion zone in accordance with the present disclosure.
Figure 5:
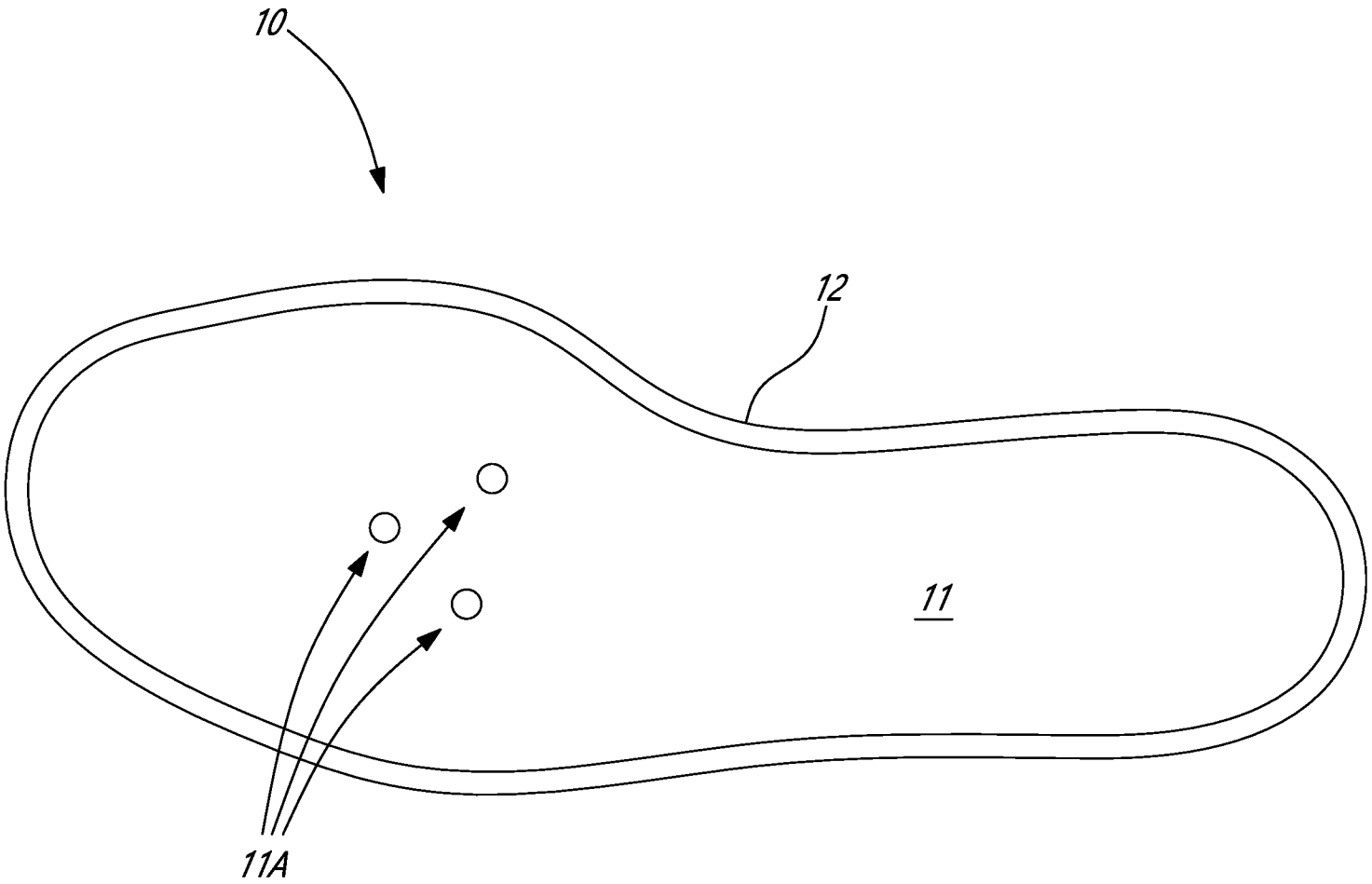
FIG. 5 is an underside view of the cycling shoe of FIG. 1.

Referring to the drawings and, more particularly, to FIG. 1, a cycling shoe in accordance with the present disclosure is generally shown at 10. The cycling shoe 10 is of the type that may be used with automatic pedals of a bicycle, and therefore has a sole 11 with connection holes 11A (FIG. 5), for fixing a cleat to the underside of the sole 11. The cycling shoe 10 may also be used with a pedal and toe clip assembly as well, and may not have connection holes 11A. The connection holes 11A are shown as being in a triangular pattern, for cleats such as Look®, Keo®, Shimano®, etc. However, the connection holes 11A may have different shapes and configurations, for other types of cleats, such as SPD®. The sole 11 in the attached figures is of the type found in road cycling shoes, with a smooth continuous surface, in contrast to grooves and legs found in mountain bike shoes or touring shoes. However, the cycling shoe 10 may also be a mountain bike shoe or a touring shoe, with a sole made for rugged terrain. In the case of a road cycling shoe, the sole 11 is rigid (i.e., substantially more rigid than elastic, with resistance to elastic deformation), in contrast to soles found in a mountain bike shoe or a touring shoe. For instance, the sole 11 in a road cycling shoe may be made of materials with plastomeric properties, such as carbon, composites, rigid plastics, in contrast to rubber or elastomers used for mountain bike shoes or touring shoes.

An upper 12 is connected to and projects upwardly from the sole 11, and forms therewith a foot-receiving cavity 13. The upper 12 generally consists of structural paneling as described hereinafter. The upper 12 may be generally separated in three areas, namely a toe portion 12A, a metatarsal portion 12B and a heel portion 12C. Without being limited to a rigid boundary, and as loosely shown in the Figs., the toe portion 12A generally covers the toes of the cyclist, whereas the metatarsal portion 12B covers the mid-portion of the foot, including the region encompassing the metatarsal bones of the wearer's foot, while the heel portion 12C protects and surrounds the heel of the wearer. The heel portion 12C may include part or all of the hindfoot, and may include the midfoot or a part thereof, and the instep. The metatarsal portion 12B, may be a rear part of the forefoot, may be separated in an outer (or lateral) sub-portion and an inner (or medial) sub-portion. The outer sub-portion generally goes from the second metatarsal bone to the side of the fifth metatarsal bone and is thus laterally positioned, whereas the inner sub-portion goes from the second metatarsal bone to the first metatarsal bone and is medially positioned. The medial sub-portion may include a bunion. The metatarsal portion 12B may include part or all of the ball of the foot. As a general observation, the vamp may include the toe portion 12A and the metatarsal portion 12B, while the quarter may include the heel portion 12C. Other constructions are contemplated as well.

The cycling shoe 10 may also include a throat 14 in the upper 12, with a tongue 15 in the throat 14, and a closure system 16. These components may or may not be present, as some cycling shoes may have a clog configuration. In the case of the closure system, a Boa® type closure system is shown, but other systems could be used as well, such as multiple Boa® type closure systems, Velcro® and ratchet straps, shoe laces, buckle and clip, for example.

Figure 7:
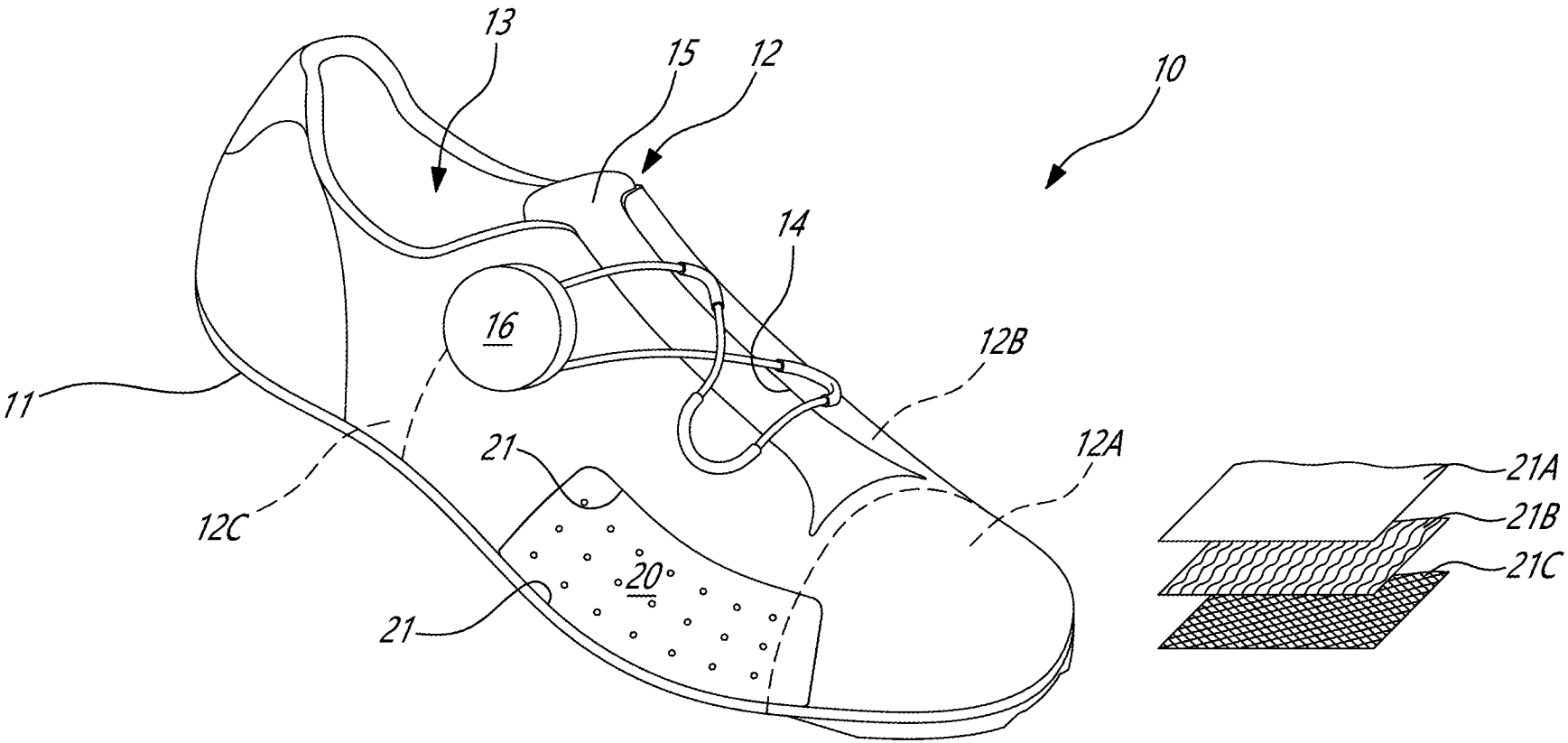
FIG. 7 is a perspective view of the cycling shoe of FIG. 1, according to another embodiment of the present disclosure.

Referring to FIG. 1, an expansion zone 20 is shown in the upper 12. More particularly, the expansion zone 20 may be mostly or entirely located in the metatarsal portion 12B of the upper 12, but may be also partially in the toe portion 12A of the upper 12, as in FIG. 1. The expansion zone 20 is located so as to be opposite the fifth metatarsal of the wearer's foot, and may also be opposite the fifth proximal phalanx of the wearer's foot. Another such expansion zone 20 may be located so as to be opposite the first metatarsal of the wearer's foot, and may also be opposite the first proximal phalanx of the wearer's foot. Such a medial expansion zone 20 may be opposite a bunion region. The shoe 10 may comprise a single expansion zone 20, whether medial or lateral, or two expansion zones 20, i.e. medially and laterally. In the illustrated embodiment, the expansion zone 20 is entirely surrounded by a window of structural paneling of the upper 12, delimited by window periphery 21. The expansion zone 20 is made of one or more panels 22 having a greater elasticity than the structural upper paneling of the window in a stretching direction, the structural upper paneling being semi-rigid, with limited planar stretch capacity. The limited planar stretch capacity may be defined as the capacity of a material to expand/stretch in its plane (e.g., if it is laid flat). The structural upper paneling has the capacity to deform so as to conform to the shape of a foot, but has limited or no planar stretch capacity. In an embodiment, the planar stretch capacity of the material of the expansion zone 20 is at least 10% greater than the planar stretch capacity of the surrounding structural paneling of the upper 12. Therefore, the expansion zone 20 may stretch or expand, relative to the surrounding structural upper paneling of the upper 12. In another embodiment, a bottom of the expansion zone 20 is delimited by the sole 11, as illustrated in FIG. 7.

In FIG. 1, the panel 22 is made of a material with elasticity characteristics (i.e., as defined, it can stretch). For example, the panel 22 may be made a multilayer membrane. According to an embodiment, the panel 22 is made with a rubbery elastomeric polymer, such as silicone, and/or polyurethane. The silicone layer may at least form the exposed surface of the panel 22. Silicone is known for its stretching capacity and for its abrasion resistance. The panel 22 may also be made from natural rubber, with other polymeric elastomers, synthetic rubbers, etc. Alternatively, the panel 22 may be a textile, such as elastane (i.e., Spandex®), namely a polyester-polyurethane copolymer. According to another embodiment, the panel 22 may comprises an exposed layer of silicone, and an inner layer of a stretchable textile—inner layer meaning interior of the silicone, for instance exposed in the cavity 13 of the cycling shoe. The layers may be laminated or connected to one another in any appropriate way, e.g., sewn. The exposed layer of elastomer therefore provides wear resistance and elasticity, and some form of water repellence (although aeration holes may be present as shown), while the inner layer of textile provides some structure to the panel 22, for example if the panel 22 is to be stitched or sewn to the surrounding structural upper paneling.

In contrast, the surrounding structural upper paneling may include various layers, such as an exterior layer of leather or synthetic leather 21A, a film 21B and a structural mesh 21C, as one of numerous embodiments. In an embodiment, the upper has no film 21B, or the film 21B is an adhesive layer used for laminating the layers 21A and 21C to one another. The layer 21A may for example be made of a polyurethane with microfibers. The resistance against stretching of the surrounding structural upper paneling is substantially greater than that of the expansion zone 20. Therefore, by being surrounded by structural upper paneling, the expansion zone 20 has no or limited power dissipating impact during pedaling, in spite of its stretchability.

Figure 2:
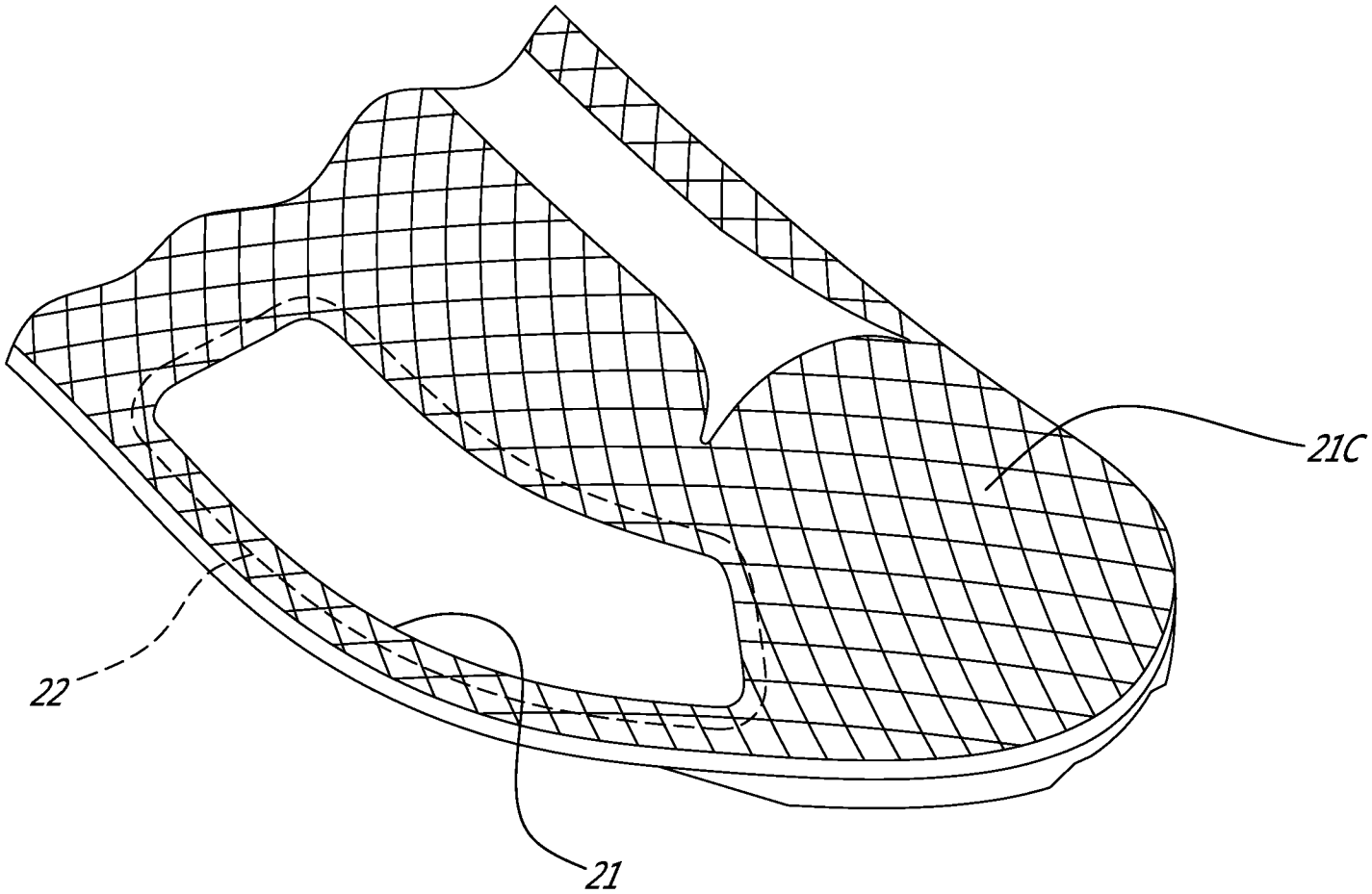
FIG. 2 is a perspective fragmented view of another embodiment of the cycling shoe with lateral metatarsal expansion zone.

As shown in FIG. 1, the panel 22 may have a perforated portion 22A, provided with aeration perforations, and an unperforated contour 22B, by which the panel 22 is attached to the surrounding structural upper paneling. For example, the contour 22B may be sandwiched between some of the layers 21A, 21B and/or 21C, and/or be laminated and/or stitched to the surrounding structural upper paneling. Hence, FIG. 2 shows the cutout in the layer 21C defining the window 21, with a periphery of the contour 22B being shown, as it would be overlaid onto the layer 21C, or positioned internally of the layer 21C. The other layers 21A and 21B may then be positioned atop the assembly of the layer 21C and of the panel 22. The contour 22B may be embroided/sewn to the layer 21C, or any other layer or combination or layers among 21A, 21B and 21C. In an embodiment, the thread used for the embroidery/stitching is a stretchable thread, such as Spandex®. According to an embodiment, the portion 22A is a pad, such as a stretchable polymeric pad, and the contour 22B is part of stretchable textile layer, such as Spandex®. The panel 22 may also be made of a monolithic piece as well. The panel 22 may have a variable thickness, to provide more localized stretchability. In an embodiment, the portion 22A has a surface ranging between 2.0 $cm^2$ and 14.0 $cm^2$, inclusively.

Figure 3:
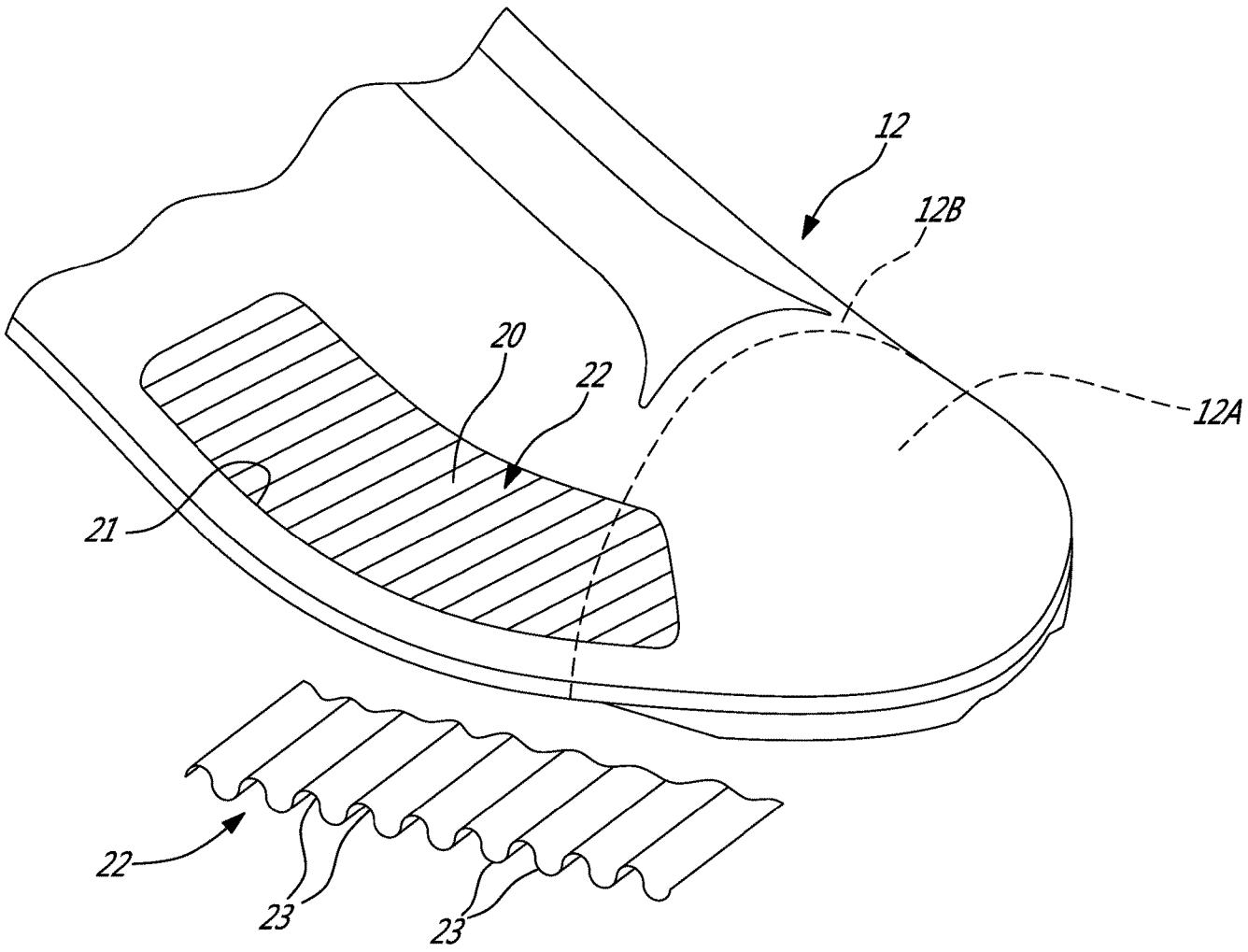
FIG. 3 is a perspective fragmented view of the cycling shoe of FIG. 2, with an exterior layer of structural upper paneling removed.
Figure 4:
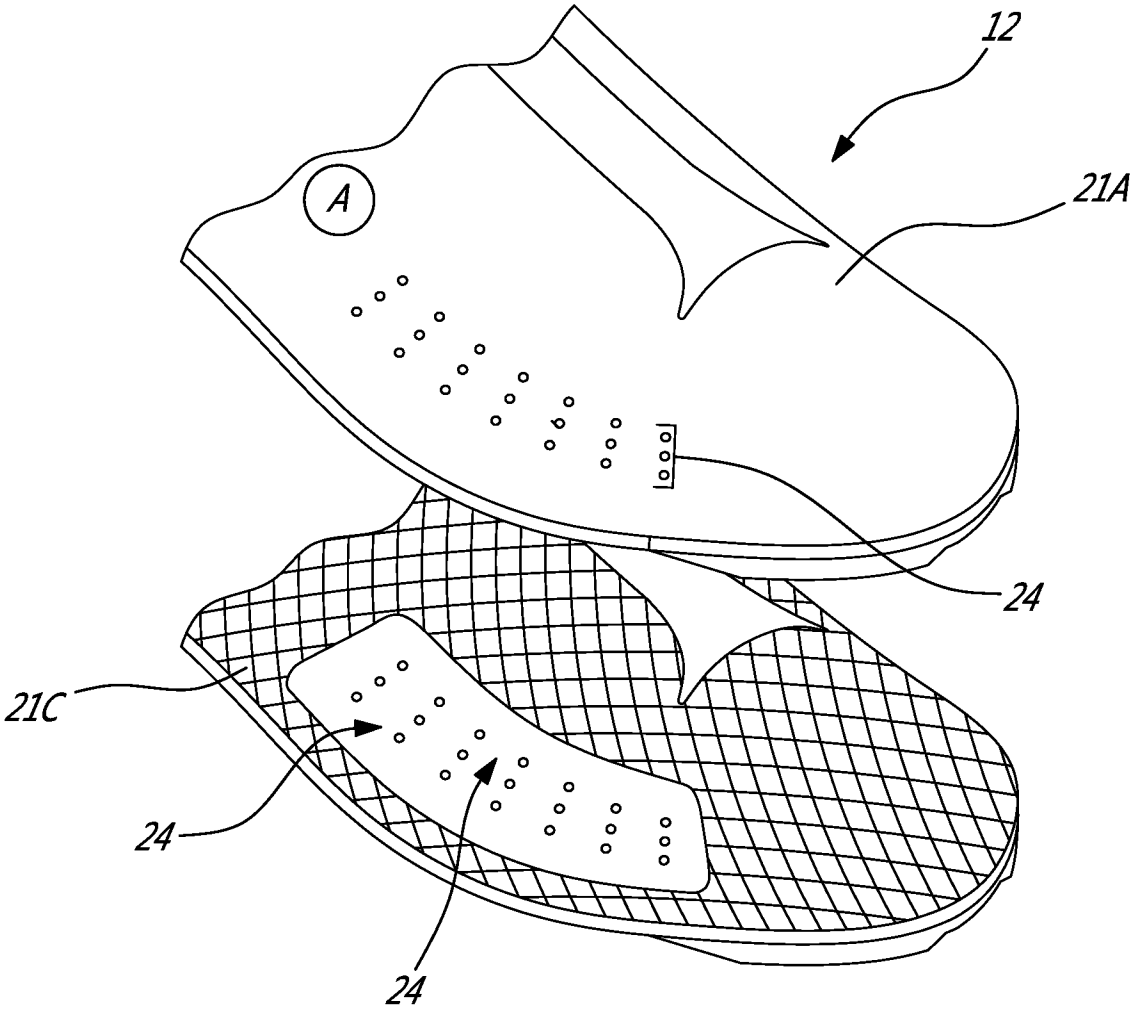
FIG. 4 is a perspective fragmented view of another embodiment of the cycling shoe with lateral metatarsal expansion zone.

Referring to FIG. 3, the panel 22 may also consist of the same material as the layer 21A, or materials with similar structural rigidity, but with folds or undulations 23, to allow expansion of the panel 22 relative to the surrounding structural upper paneling. Referring to FIG. 4, the zone is defined by a plurality of perforations 24 in the layer 21A and 21C, the perforations giving some stretching elasticity to the expansion zone 20 (i.e., in a plane of the expansion zone 20). Alternatively, the layer 21B and 21C, if present, may have a window 21 free of material so as not to add rigidity to the expansion zone 20, as in FIG. 2.

Figure 6A:
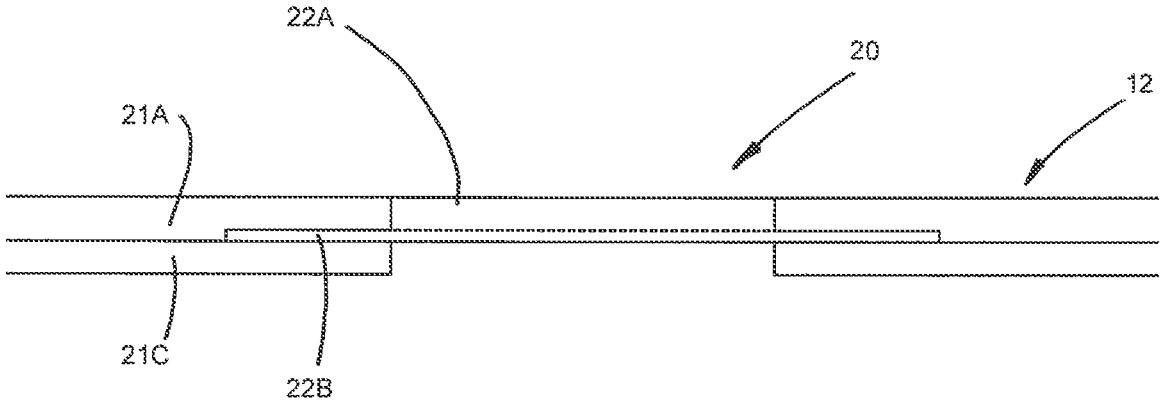
FIG. 6A is a sectional view of an exemplary construction of the expansion zone of FIG. 1 relative to structural upper paneling.
Figure 6B:
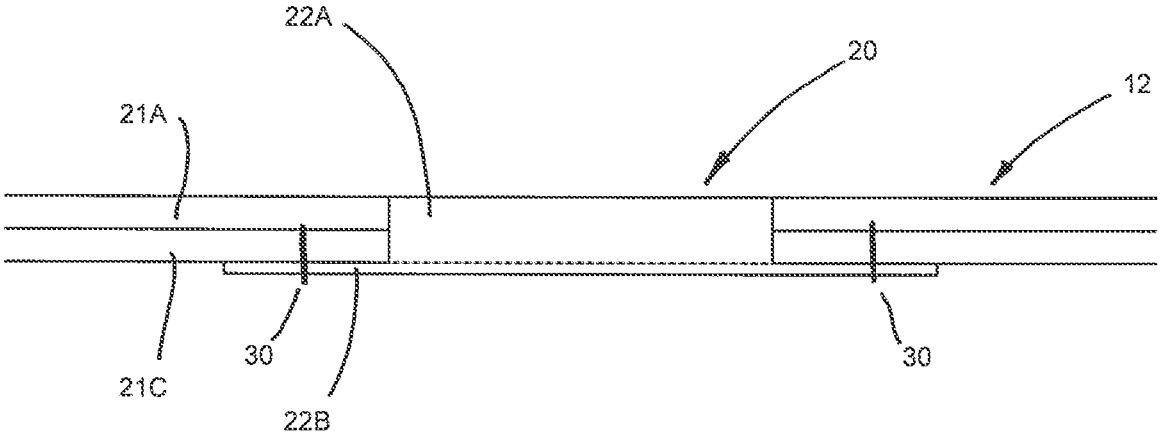
FIG. 6B is a sectional view of another exemplary construction of the expansion zone of FIG. 1 relative to structural upper paneling.

FIGS. 6A and 6B show possible constructions of the shoe 10, at the expansion zone 20. The panel 22 is shown as having a stippled line separating the panel 22 in a layer 22A and a layer 22B, based on the description provided above. However, as clearly described above, the panel 22 may be made of a single material or layer. The contour 22B may be sandwiched between layers 21A and 21C of the upper structural paneling, or may be connected to an inside surface of the layer 21C. Lamination, gluing, stitching 30, are possible manners used to secure the expansion zone 20 to the upper structural paneling. For example, even though the stitching 30 is shown in FIG. 6B, it may also be part of FIG. 6A.

While the present disclosure details the use of the expansion zone in a cycling shoe 10, it is considered to provide such expansion zones in other types of shoes as well. According to an embodiment, the exposed surface of the panel 22 is flush with the material of the window 21 surrounding it, to form a continuous surface without any raised edge. It is also contemplated to provide the expansion zone 20 in other types of items of footwear, such as running shoes, boots, etc, for any other activity.

The invention claimed is:

1. A cycling shoe comprising:

a rigid sole defining an undersurface of the cycling shoe from a toe portion to a heel portion of the cycling shoe, the rigid sole having connection holes defined in the undersurface, the connection holes configured for connection of a pedal cleat to the rigid sole; and an upper connected to the rigid sole and defining with the rigid sole a foot-receiving cavity, the upper having a structural upper paneling, at least one expansion zone located in a lateral subportion of a metatarsal portion and/or toe portion of the cycling shoe and configured to face against a portion of at least a fifth metatarsal of a wearer of the cycling shoe, and/or located in a medial subportion of a metatarsal portion and/or toe portion of the cycling shoe and configured to face against a portion of at least a first metatarsal of a wearer of the cycling shoe, the at least one expansion zone being entirely surrounded by a periphery of a window in the structural upper paneling and by the rigid sole, a bottom of the window ending at the rigid sole, the at least one expansion zone defined by at least one panel having a greater stretching characteristics than the structural upper paneling on the periphery of the window, the at least one panel being expandable relative to the structural upper paneling on the periphery of the window, the at least one expansion zone defining a wall surface of the foot-receiving cavity of the cycling shoe to allow expansion of the foot-receiving cavity at the at least one expansion zone.

2. The cycling shoe according to claim 1, wherein the at least one panel comprises a layer of stretchable fabric or material.

3. The cycling shoe according to claim 1, wherein the at least one panel comprises a layer of elastomer forming the wall surface of the foot-receiving cavity.

4. The cycling shoe according to claim 3, wherein the layer of elastomer is a layer of silicone.

5. The cycling shoe according to claim 3, further comprising a layer of stretchable fabric laminated to the layer of elastomer.

6. The cycling shoe according to claim 1, wherein the at least one panel has a plurality of perforations.

7. The cycling shoe according to claim 1, wherein the at least one panel is laminated to the structural upper paneling.

8. The cycling shoe according to claim 1, wherein the at least one panel is stitched to the structural upper paneling.

9. The cycling shoe according to claim 1, wherein a periphery of the at least one panel is sandwiched between layers of the structural upper paneling.

10. The cycling shoe according to claim 1, wherein the structural upper paneling has an exterior layer of polyurethane with microfibers.

11. The cycling shoe according to claim 1, wherein the structural upper paneling has an interior structural mesh layer.

12. The cycling shoe according to claim 1, wherein the at least one panel is made of a perforated outer layer of the structural upper paneling, with a window cutout in the structural upper paneling under the perforated outer layer.

13. The cycling shoe according to claim 1, wherein the rigid sole is a rigid plastomer sole.

14. The cycling shoe according to claim 1, wherein the at least one expansion zone is located in the lateral subportion of the metatarsal portion and of the toe portion of the cycling shoe and configured to face against a portion of the fifth metatarsal and a portion of the fifth proximal phalanx of the wearer of the cycling shoe.

15. The cycling shoe according to claim 1, wherein the expansion zone is located in the medial subportion of the metatarsal portion and of the toe portion of the cycling shoe and configured to face against a portion of the first metatarsal and a portion of the first proximal phalanx of the wearer of the cycling shoe.

16. The cycling shoe according to claim 1, wherein the at least one expansion zone is entirely located in the lateral subportion of the metatarsal portion of the cycling shoe.

17. The cycling shoe according to claim 1, wherein the at least one expansion zone is entirely located in the medial subportion of the metatarsal portion of the cycling shoe.

18. The cycling shoe according to claim 1, wherein the at least one expansion zone has an area ranging from 2.0 $cm^2$ to 14.0 $cm^2$.

19. A cycling shoe comprising:

a rigid sole defining an undersurface of the cycling shoe from a toe portion to a heel portion of the cycling shoe, the rigid sole having connection holes defined in the undersurface, the connection holes configured for connection of a pedal cleat directly to the rigid sole; and an upper having a structural upper paneling, the upper connected to the rigid sole and defining with the rigid sole a foot-receiving cavity, at least one expansion zone being a fifth-metatarsal covering portion located in a lateral subportion of a metatarsal portion and/or toe portion of the cycling shoe, and/or first-metatarsal covering portion located in a medial subportion of a metatarsal portion and/or toe portion of the cycling shoe, the at least one expansion zone being entirely surrounded by a periphery of a window in the structural upper paneling and by the rigid sole, a bottom of the window ending at the rigid sole, the at least one expansion zone defined by at least one panel having a greater stretching characteristics than the structural upper paneling along the periphery of the window, the at least one panel being expandable relative to the structural upper paneling along the periphery of the window, the at least one expansion zone defining an interior facing surface of the cycling shoe to allow expansion of the foot-receiving cavity at the at least one expansion zone.

20. The cycling shoe according to claim 19, wherein the at least one panel has a planar stretch capacity at least 10% greater than that of the surrounding structural paneling of the window.

21. The cycling shoe according to claim 19, wherein the at least one expansion zone has an area ranging from 2.0 $cm^2$ to 14.0 $cm^2$.

22. A cycling shoe comprising:

a rigid sole having a foot receiving side and defining an undersurface of the cycling shoe on an opposite side, the rigid sole having at least a heel portion and an adjacent metatarsal portion, an upper having a structural upper paneling, the upper connected to the rigid sole and defining with the rigid sole a foot-receiving cavity, at least one expansion zone located in a lateral subportion of a metatarsal portion and/or toe portion of the cycling shoe and configured to face against a portion of at least a fifth metatarsal of a wearer of the cycling shoe, the at least one expansion zone having a periphery defined by a window of structural upper paneling and a portion of the rigid sole, a bottom of the window ending at the rigid sole, the at least one expansion zone defined by at least one panel having a greater stretching characteristics than the window in the structural upper paneling, the at least one panel being stretchable relative to the window in the structural upper paneling and secured thereto, to allow expansion of the foot-receiving cavity at the at least one expansion zone.

23. The cycling shoe according to claim 22, wherein the at least one panel has a perforated portion having aeration perforations and an unperforated contour, the unperforated contour attached to the surrounding structural upper paneling.

24. The cycling shoe according to claim 22, wherein the at least one expansion zone has an area ranging from 2.0 $cm^2$ to 14.0 $cm^2$.

* * * * *